US005823511A

United States Patent [19]

Hall et al.

[11] Patent Number: 5,823,511

[45] Date of Patent: Oct. 20, 1998

[54] FORCE GENERATION DEVICE FOR SIMULATION OF SHOULDER-SUPPORTED ROCKET LAUNCHING

[75] Inventors: Bart Hall, North York; Julius J. Grodski, Toronto, both of Canada

[73] Assignee: Her Majesty the Queen in right of Canada, as represented by Minister of National Defence of her Majesty's Canadian Government, Ottawa, Canada

[21] Appl. No.: 712,642

[22] Filed: Sep. 11, 1996

Related U.S. Application Data

[60] Provisional application No. 60/005,219 Oct. 12, 1995.

[30] Foreign Application Priority Data

Apr. 9, 1996 [CA] Canada ..... 2173678

[51] Int. Cl.[6] ..... B66D 1/00; B66C 13/22

[52] U.S. Cl. ..... 254/264; 212/273; 434/18; 901/34

[58] Field of Search ..... 254/269, 270, 254/272, 273, 335, 334, 336, 337, 338; 901/34, 16; 434/18; 212/273, 276

[56] References Cited

U.S. PATENT DOCUMENTS

| | | | |
|---|---|---|---|
| 2,551,079 | 5/1951 | Winther | 254/269 |
| 3,826,380 | 7/1974 | Lenander et al. | 212/273 |
| 4,180,171 | 12/1979 | Cunningham et al. | 212/273 |
| 4,524,952 | 6/1985 | Rome et al. | 254/269 |
| 4,733,603 | 3/1988 | Kukoij . | |
| 4,836,111 | 6/1989 | Kaufmann | 901/16 |
| 4,964,061 | 10/1990 | Grodski et al. . | |
| 5,117,276 | 5/1992 | Simkus, Jr. et al. | 212/276 |
| 5,314,082 | 5/1994 | Konop | 212/276 |
| 5,358,219 | 10/1994 | Schenk et al. | 254/269 |
| 5,445,282 | 8/1995 | Erikkila | 901/16 |

FOREIGN PATENT DOCUMENTS 0219327 4/1987 European Pat. Off. .

OTHER PUBLICATIONS

Hall, et al.: "Force Generation Device For Simulation of Shoulder–Supported Rocket Launching", Oct. 16–18, 1995, pp. 365–372; Proceedings of the 1995 Robotics & Knowledge Based Systems Workshop; Quebec, Canada.

*Primary Examiner*—Katherine Matecki
*Attorney, Agent, or Firm*—Larson & Taylor

[57] ABSTRACT

A system for exerting a force, for instance a vertical upward lifting force of a predetermined tension vs. time waveform on a suspended object is useful in training the operators of shoulder-supported rocket launchers. The system includes an actuator for generating a required tensile force, a non-stretchable line or cable for connecting the object to the actuator and an overhead guide supported on an overhead support structure. The cable passes over the guide means defining a portion of the cable directly supporting the object. The position of the guide is controlled, in a response to a deviation from verticality of the portion of the cable with suspended object, before the activation of the actuator so that the verticality of the object lifting force is maintained. In operation, a predetermined force is exerted on the object regardless of whether the object moves as a result of the force.

17 Claims, 8 Drawing Sheets

FORCE GENERATION DEVICE FOR SIMULATION OF SHOULDER-SUPPORTED ROCKET LAUNCHING

This application is a provisional application Ser. No. 60/005,219 filed Oct. 12, 1995.

FIELD OF THE INVENTION

This invention relates to force generation systems and particularly to a force generation system useful for instance in the simulation of shoulder-supported rocket launching.

BACKGROUND OF THE INVENTION

In certain instances, it is desirable to create a weight-loss or weight-unloading effect and thereby reduce the perceived weight and perceived weight distribution of an object supported by a person. Such need exists for instance in the training of shoulder-fired missile operators.

Shoulder-fired guided missile systems are an integral part of modern defense operations. The effectiveness of these weapons is related directly to the quality of the training the operators receive. Live firing of these weapons provides optimal training experience but is prohibitively expensive. Hence, simulator-based training is preferred.

Effective simulators for tripod-supported launchers are known. They reproduce the visual and aural aspects of real systems through the use of computer graphics and sound capabilities. In shoulder-supported launching, however, the additional critical element of physically supporting the launcher is involved. Given that a typical missile may weigh 20 to 28 lbs, or 9 to 12.6 kg, the launcher's weight and centre of gravity change dramatically at the instant the rocket/missile leaves the launch tube. The rapid loss of mass and weight of the missile creates the problem of a transient motion of the operator and the tube which equates to a perturbation in aiming. Such perturbation may have very serious consequences, including being exposed to enemy fire, as known to those familiar with the art.

Therefore, it is essential to prepare the operator for the physical changes experienced during the launch so that the operator may develop counteractive reactions helpful in aiming and delivering the missile to the target.

A system for training the operator for the above purpose should deal with several factors, viz. the rapidity and dynamics of launch, the direction of the weight loss and secondary forces.

The loss of weight during a real launch occurs typically in a fraction of a second. Following the launch, the operator's muscles keep exerting the upward pushing force that may lead to the disturbance in aiming as discussed above. Furthermore, the loss of weight must retain fidelity in the presence of operator motions. The operator's motions should be relatively small as the successful launch requires the operator to remain still and steady for the duration of a shot. Another condition is that the simulated lift force should be as close as possible to a vertical direction. This is so because the real missile weight loss occurs in the direction of gravity i.e. vertically downwards.

Further, in a launch simulation exercise, the upward stroke of the lifting force should not deviate significantly from the amount of the real-life upward shift of the launcher caused by the muscular reaction of the operator up on the loss of missile weight.

Other forces than the vertically oriented weight loss are also present during launch. While the front-to-rear recoil of the jolt is reduced in rockets because the action of the exhaust gas of the rocket is not constrained by a closed launch barrel end, certain forward/backward forces are still present due to recoil, friction between the missile and the launcher during the shot, and other factors. However the most important perturbation to be countered is the missile weight loss. The recoil force in the case of self-propelled missiles is very much lesser than the recoil force on the closed end of a cannon or gun barrel. Its effect on the operator is minimized by the open tube design of the launcher and the two-stage firing sequence. In the first stage, a much more powerful thrust is designed to eject the missile from the launch tube, while in the second stage, missile propulsion takes place at a distance from the operator.

Known devices for aiding the operator in training have dealt with the problem of weight loss but not with the verticality of the weight-loss force. A cable/rope pull-down device uses ropes for temporarily affixing an empty launch tube to the floor/ground thus creating an added weight effect, and releasing the rope tension at the instant of "firing" to simulate the missile weight loss. The ropes are positioned vertically between the tube and their attachment points at the floor or ground. The drawback of this approach is in the restricted mobility of the operator who is likely to move, deliberately or not, directly before the launch. Any deviation from the proper position before the launch creates a deviation from the verticality of the weight-loss forces. It may also introduce a significant error in the perceived forces and thereby impede the training process.

Another method used an approximation of an empty launcher having two weights, one at the front and one at the rear of the launch tube, secured releasably to the tube with a weight-release mechanism. The weights were released at the instant of simulated firing. This approach, while overcoming the problem with the mobility of the operator and the verticality of the weight loss force had also disadvantages including an added weight of the weight-release mechanism itself and the risk of the falling weights disturbing or harming the operator, the latter necessitating extra personnel.

It is an object of the invention to provide a system wherein at least some of the above-discussed drawbacks are alleviated or eliminated.

It is another object of the invention to provide a system and a method for generating and exerting on an object a force of a predetermined magnitude-versus-time waveform, wherein the stroke or displacement created by the force is a secondary factor.

It is yet another object of the invention to provide a method of exerting a virtually vertical tensile force of a predetermined tension vs. time waveform on an object such as a simulated rocket launcher.

SUMMARY OF THE INVENTION

According to the invention, there is provided a system for exerting a predetermined force on an object, especially on a predetermined point of the object, in a predetermined direction, the system comprising:

- a reference structure disposed at a predetermined position relative to the object,
- an actuator associated with the reference structure for generating a force of predetermined magnitude vs. time waveform (i.e. magnitude as a function of time),
- a control means operatively connected with the actuator for activating the actuator in a predetermined time-related manner, and a link means operatively connecting the object with the actuator for imparting, in operation, the force onto the object.

The actuator may be designed, or adapted, for generating a tensile, compressive (push) or another type of force of predetermined magnitude as a function of time.

The link means may be a flexible or a rigid link, depending on the operational requirements. It is understood that the link means is not limited to a single link as described for the exemplary embodiments of the invention hereinbelow, if a plurality of links is feasible and desirable.

The system may comprise guide means associated with the reference structure for guiding the link means along a predetermined route, or for maintaining a predetermined orientation of the link means.

In a specific aspect of the invention, there is provided a guide system for use in an actuating system which comprises an actuator and a flexible link means for connecting the actuator with an object. The guide system comprises a frame (a reference structure), a link positioning means movable with respect to the frame, position detecting means for detecting a directional orientation of the link means and generating a signal indicative of a deviation of the directional orientation of the link means from a predetermined orientation, and moving means for moving said link positioning means in response to said signal to achieve a predetermined orientation of said link means.

The reference structure may be an existing one or designed for a specific purpose and it may be disposed at various positions relative to the object depending on the desired force to be imparted thereto. In a specific embodiment of the invention, with an object to be lifted, the structure may be an overhead support structure. In the latter instance, the overhead support structure may be e.g. a scaffolding or a similar support structure of sufficient size to accommodate the height of the operator. The guide means may be installed on such existing structure. It will be understood that the existing structure or its part then becomes a functional part of the invention inasmuch as it provides a physical basis for the operation of the system.

The guide means may be movable such that its position relative to a fixed point on the ground can be changed. While the guide may be movable along with the support structure or its part, in an embodiment of the invention the guide is movable relative to the stationary structure.

The system of the invention operates on a different principle than known actuating systems, e.g. a common overhead crane or hoist. The vertical lift operation of a crane or hoist is fundamentally different in the selection of means and purpose than the system of the invention. In a crane, the lift cable is connected to a high strength, high mechanical impedance drive, typically a gear reduced driven drum. The drum is connected to a high strength motor. In operation, the motor is activated for periods of time when it operates at a relatively constant or controlled speed. The drum is intended to dispense or wind up cable at that rate, independent of whether a heavy or light object is hanging on the end of the cable. The overall objective of crane operation is to lift the object to a desired position (stroke) independently of how heavy the object is and hence independently of how much lift force is applied. The operation, understandably, is limited to lift forces within the capability of the crane.

In contrast to the above, the system of the invention is specifically designed to exert a predetermined force, in the time-related manner, on an object independent of whether the object moves in response to the application of that force (a "stroke-independent force"). In the exemplary embodiment of the invention, described hereinbelow, a system is described that can apply a prescribed force regardless of whether or not the object (launch tube) moves upward as a result.

BRIEF DESCRIPTION OF THE DRAWINGS

In drawings which illustrate the system of the invention and its operation in greater detail.

DETAILED DESCRIPTION OF PREFERRED EMBODIMENTS OF THE INVENTION

Figure 1:
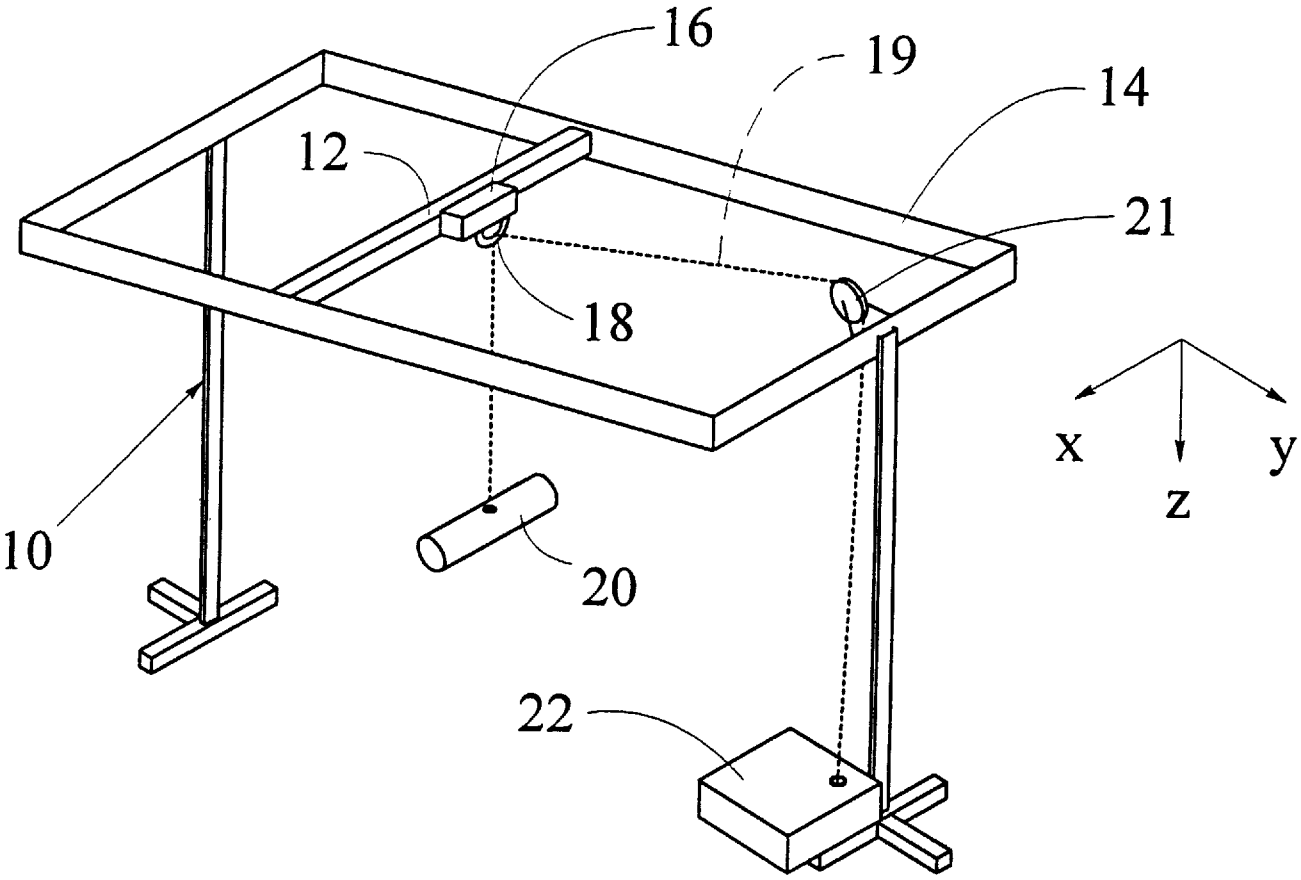
FIG. 1 is a view of an embodiment of the system of the invention prepared for operation.

Referring now to the drawings, FIG. 1 illustrates a frame 10 supporting an x-y gantry arrangement consisting of beams 14, a cart 12 and a cart 16. The cart 12 is slidable along the longer beams 14 of the frame 10, and the cart 16 is slidable along the length of the cart 12. The cart 16 has an guide 18 which may be an eyelet, a pulley or another guide enabling the longitudinal passage of a cable 19 thereover or therethrough.

While the system of the invention does not encompass an object to be lifted, the cable 19 is shown in FIG. 1 as attached to a mock-up rocket launcher 20 including a weight equivalent to the actual mass of a missile, the weight being positioned realistically within the launcher tube of the launcher assembly. The definition "realistically" means that the pseudo-missile is positioned so that its center of gravity matches the location of the center of gravity of a real missile, thus approximating real launch conditions. The cable 19 is attached to the launcher as close as possible to the centre of gravity of the "missile" inside the launcher. The cable has a first, vertical section defined by the object and the guide 18. At the other end, the cable 19 is engaged, via a pulley 21, with a control module 22 which is secured to the frame 10. The module 22 contains the control mechanisms of the system, not shown in FIG. 1, including a take-up spooling mechanism, a servomechanism for controlling the position of the guide 18 and a robotic muscle-like pneumatic actuator, shown in FIG. 7, which is associated with actuator control means. The operation of the control mechanisms will be explained below.

Apart from the above-described embodiment, the point of the application of force to an object is generally chosen according to some criterion (e.g. center of mass) related to the nature of either an entire object or a portion (e.g. the "missile") of the overall object (launcher encompassing the missile).

Due to possible mechanical limitations, such as the flexibility and bending of the support structure under the load, the guide means may not be, and does not have to be, movable in exactly a horizontal plane. As illustrated in FIG. 1, the guide is movable in a direction having an x and/or y component such as to impart a movement of the first section of the link means with the object attached thereto, in a x and/or y direction, perpendicular to the vertical (z axis).

The range of travel of the x-y gantry elements 12, 16 is about 2×2 feet, or 60×60 cm, which is sufficient to accommodate movements of an operator underneath the frame. For the launch simulation discussed above, the operator holds the object (launcher) 20 on the shoulder under the x-y gantry 12, 14, 16 within the vertical projection of the range of travel of the gantry elements, to enable control means, discussed below, to maintain verticality of the cable 19 at the moment of object lifting. The control means cause the guide 18 to get into a position virtually vertical above the point of attachment of the cable 19 to the object 20.

It should be recognized that the control module 22 may be mounted at various positions relative to the support structure, for instance it may be anchored to the gantry elements 12, 16. Accordingly, the cable 19 may extend downwards from the control module to the object, the entire operational length of the cable constituting the first portion thereof. In such a case, the control module would also constitute the guide means as it would be movable to position the cable vertically over the object.

Figure 2:
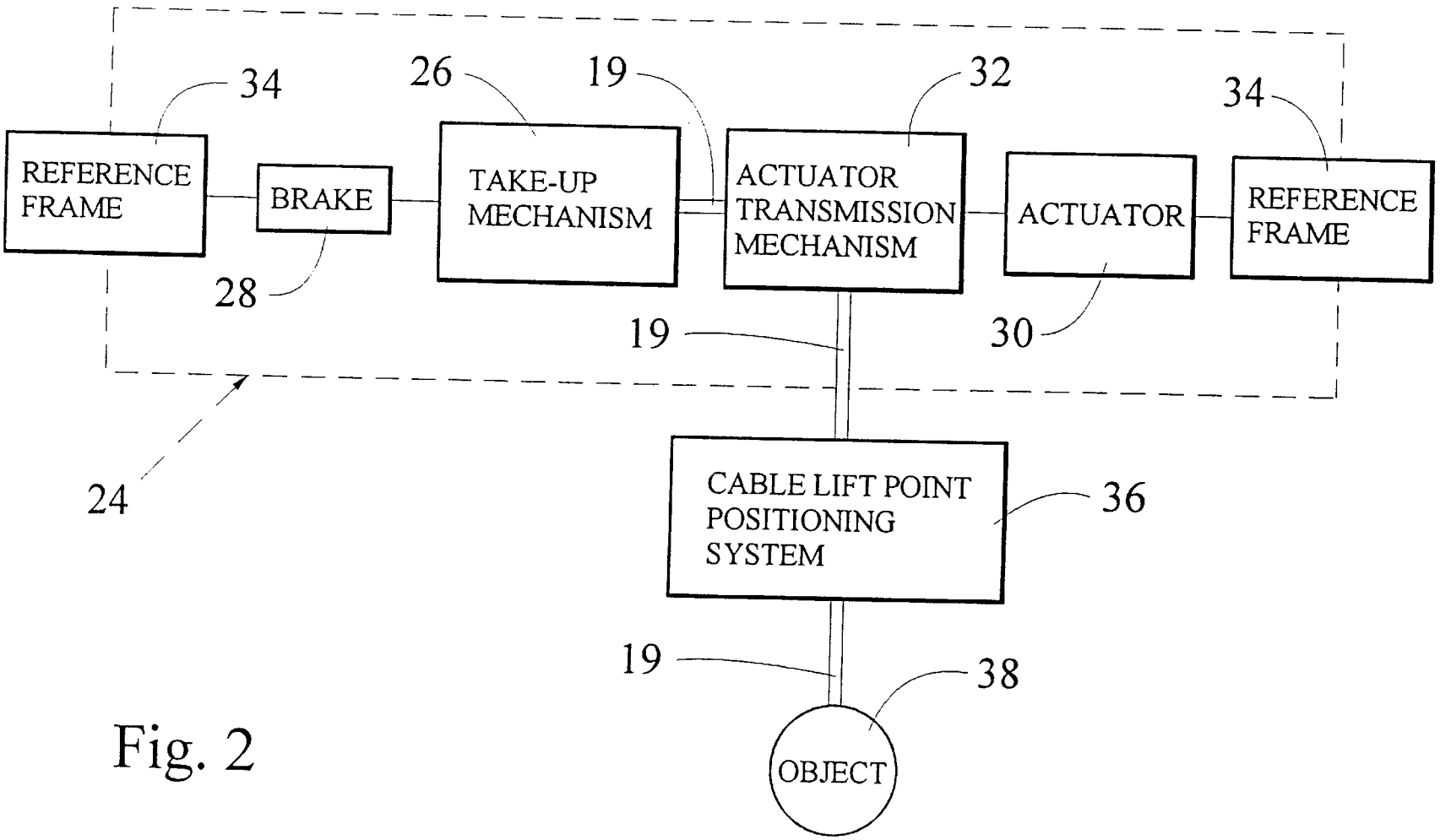
FIG. 2 is a block diagram of the basic components of one embodiment of the system of the invention.

Referring now to FIG. 2, a cable tension generation control system 24 is indicated in phantom lines. It includes a number of functionally associated components, including a take-up spooling mechanism 26 associated with a brake 28, an actuator 30 associated with an actuator force transmission mechanism 32, and a reference frame 34 which may be embodied by the casing of the control module 22 when affixed to the frame 10 or another fixed support. The take-up spooling mechanism 26 is exemplified by an electric motor of a capacity sufficient to maintain a low take-up tension in the cable 19, and a wind-up drum. The latter is preferably equipped with a sideways incremental motion so that a single-layer cable winding is maintained on the drum at all times thus preventing cable wedging and jamming. The actuator 30 and the brake 28 are each mechanically anchored to the reference frame 34. Alternatively, the reference frame may be affixed to the cart 12 or cart 16 with the implication that the control system 24 is residing at that location.

The tension generation control system 24 engages the cable 19 which passes through a cable lift point positioning system 36 and extends to the object 38 to be lifted.

In operation, when the operator holds the object 38 on the shoulder underneath the frame 10, within the travel range of the gantry 12, 16, the low-tension take-up mechanism 26, e.g. a spooler, is activated to keep a steady, low tension on the cable 19, the tension being sufficient to keep the cable substantially taut without distracting the operator. The tension should also enable the operator to move within the above-discussed range, bend, crouch and lie down.

When activated, the cable lift point positioning system 36 which includes the guide 18 (FIG. 1) functions to position the guide 18 vertically above the object 38. This function is accomplished through the monitoring of the verticality of the cable 19 in its section adjacent to the object. The monitoring is effected by means of an angle sensor described hereinbelow.

For the main step of the operation of the system of the invention, the application of the object lifting force, the brake 28 is activated to immobilize the take-up mechanism, or generally speaking, to arrest the longitudinal movement of the cable relative to the guide 18. The actuator 30 is then activated to generate a pulling force of a predetermined tension-versus-time waveform. The transmission mechanism 32 converts the actuator stroke and tension to adapt them to the requirements of the lifting exercise, i.e. required force and stroke of lift. In the embodiment illustrated in FIG. 7, the actuator is a pneumatic muscle-like robotic actuator (known in the art as ROMAC) and the transmission mechanism is an inverted tackle. Thus, the tension of the actuator becomes reduced by a factor of say, six and the stroke is extended by the same factor.

The spooling feature of the take-up mechanism allows the system to naturally self-adapt to any height of the operator as well as accommodate multiple firing stances (prone, kneeling, standing). Preferably, to avoid excessive friction and wedging of the cable on the spooler drum, a single-layer winding spooler is preferred.

Figure 3:
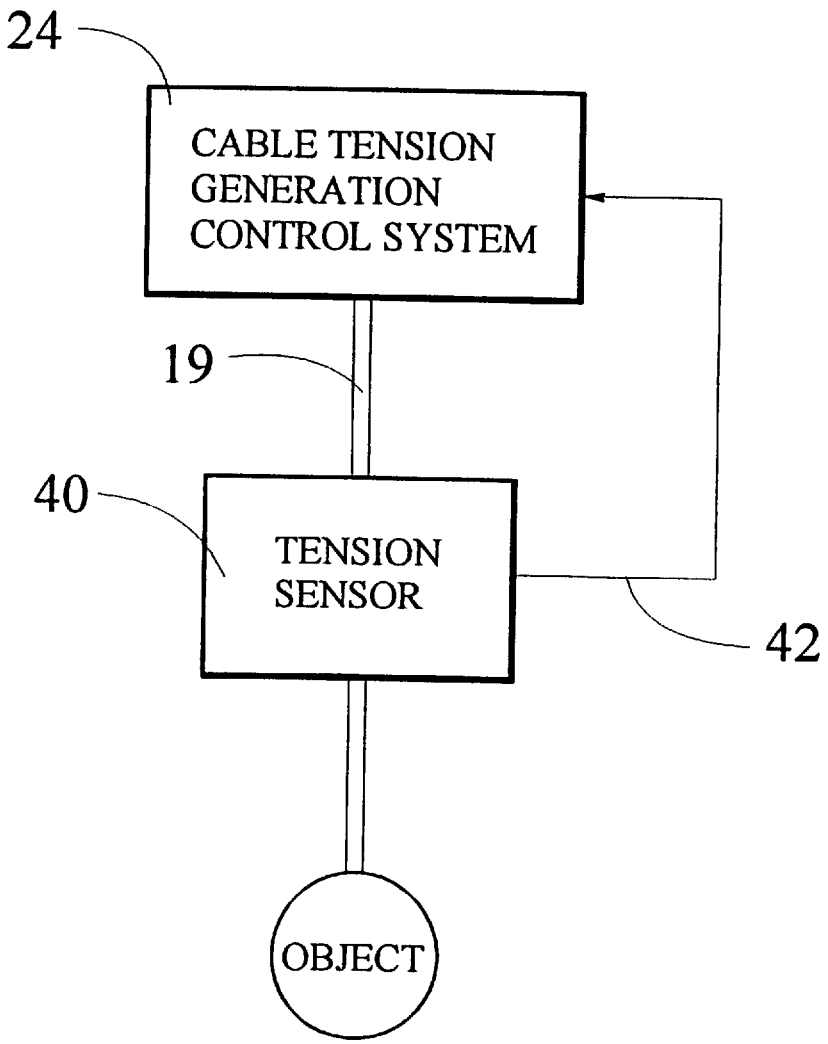
FIG. 3 is a block diagram of the cable tension sensing assembly.

Referring now to FIG. 3, the operation of the cable tension generation control system 24 (FIG. 2) is controlled via feedback from a cable tension sensor 40. The tension sensor is operatively associated with the cable 19 to generate a feedback loop 42, allowing the system to react to the majority of physical forces associated with the performance of the system, thus improving its fidelity.

Figure 4:
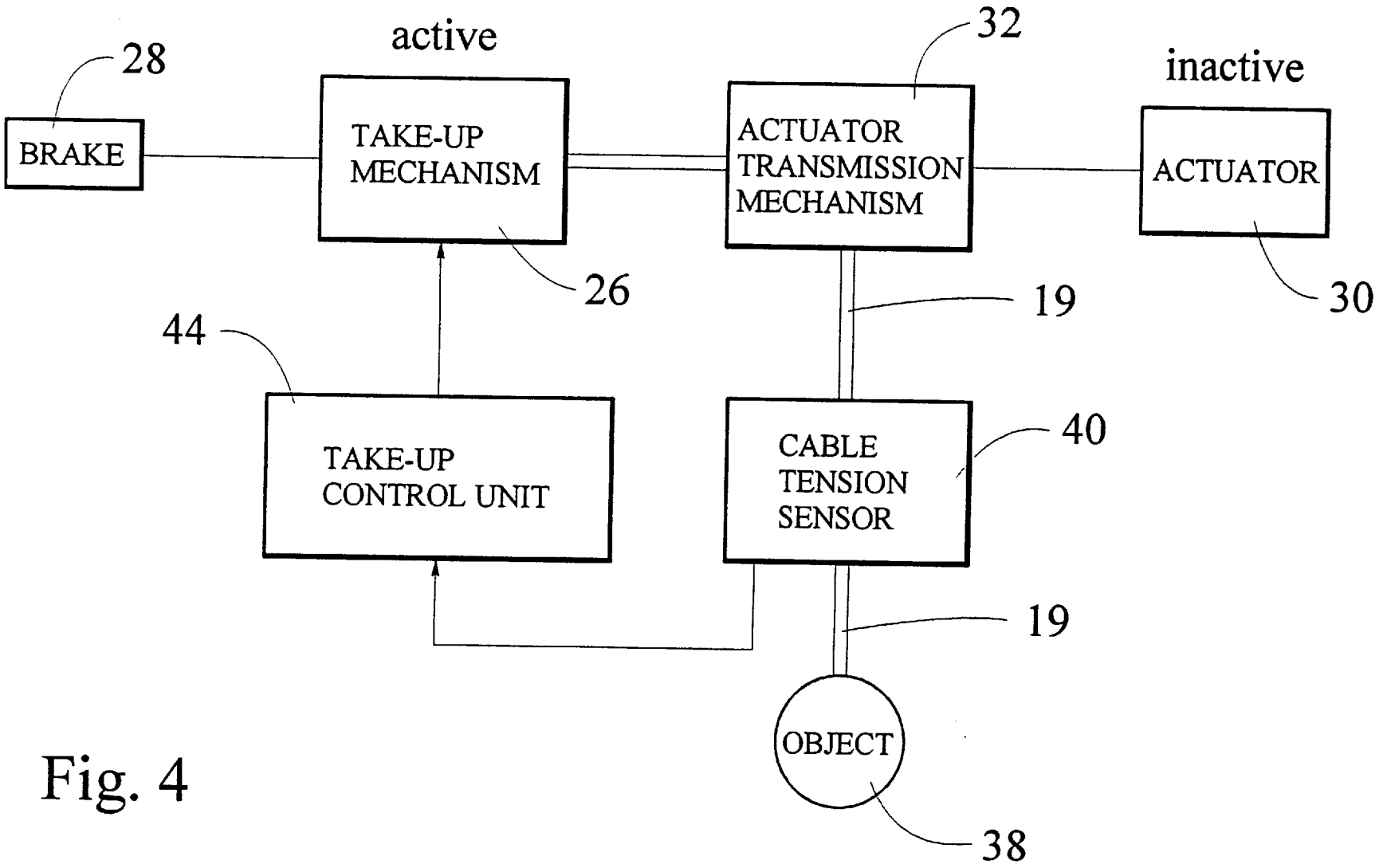
FIG. 4 is a block diagram illustrating the functioning of the first embodiment before the application of a lifting force.
Figure 7:
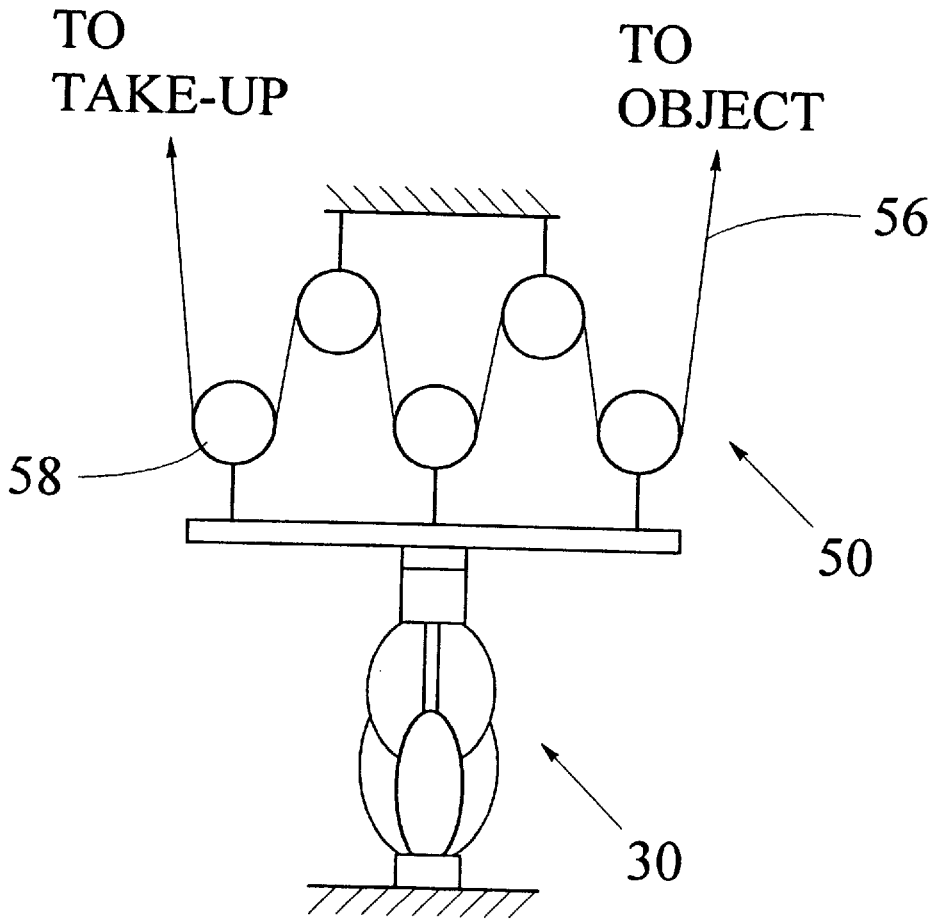
FIG. 7 is a view of the robotic muscle-like actuator with a stroke-modifying mechanism.

The operation of the low-tension take-up mechanism 26 will be described in more detail based on FIG. 4 which illustrates schematically the system before the application of the lifting force. The actuator 30 is inactive, the brake 28 is disengaged allowing the take-up mechanism 26 to operate. The operation of the mechanism 26, as explained, aims at canceling any slack of the cable 19 when the object 38 is supported by the operator. The mechanism 26 (active) spools the cable in or out to maintain a small tension in the cable. The tension is monitored by the tension sensor 40 which generates a signal indicative of the tension to a take-up control unit 44 which in turn controls the take-up mechanism 26. At this stage of operation, the cable 19 which extends between the object 38 and the take-up mechanism, passes freely through the actuator force transmission mechanism 32 which is illustrated in FIG. 7.

Figure 5:
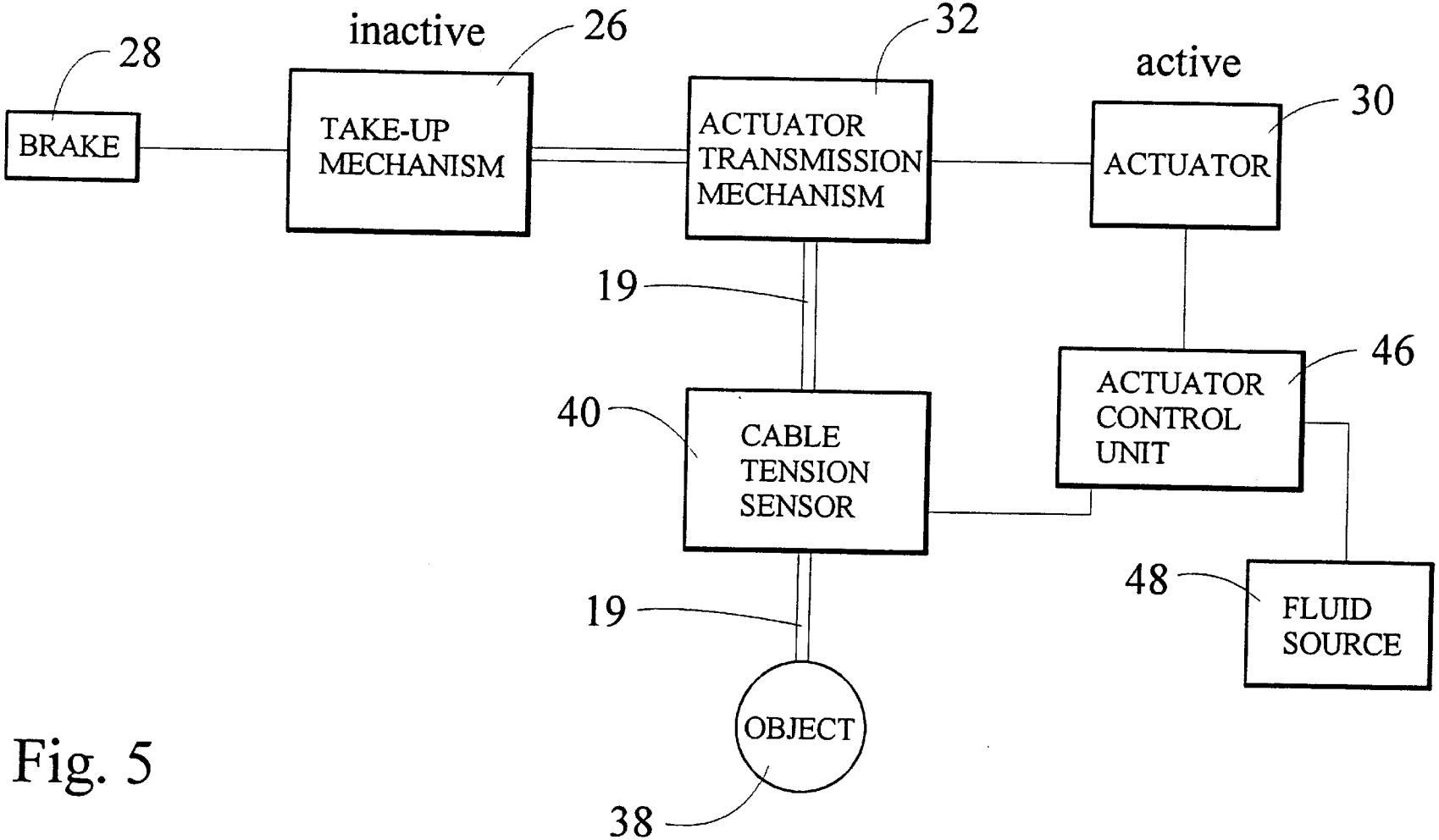
FIG. 5 is a block diagram illustrating the functioning of the first embodiment during the application of a lifting force.

The operation of the system during the application of the lifting force is represented in FIG. 5. Here the take-up mechanism 26 is inactivated due to the brake 28 being engaged. As a result, the cable 19 is anchored against the reference frame through the take-up mechanism. The actuator 30, anchored against the same reference frame (FIG. 2) is actively generating a tensile force and exerting the force between the reference frame and the actuator transmission mechanism (described in detail with reference to FIG. 7). The operation of the actuator is controlled by an actuator control unit 46 in response to a signal from the cable tension sensor 40. The actuator generates a force proportional to its internal pressurization. A pressurized fluid source 48, typically a compressed air source, is modulated via the actuator control unit 46 such as to exert an appropriate internal actuator pressure to maintain the proper cable lift force. The unit 46 includes a proportional, fast acting servo valve adapted to add or exhaust compressed air to or from the actuator based on the tension signal from the cable tension sensor 40.

Figure 6:
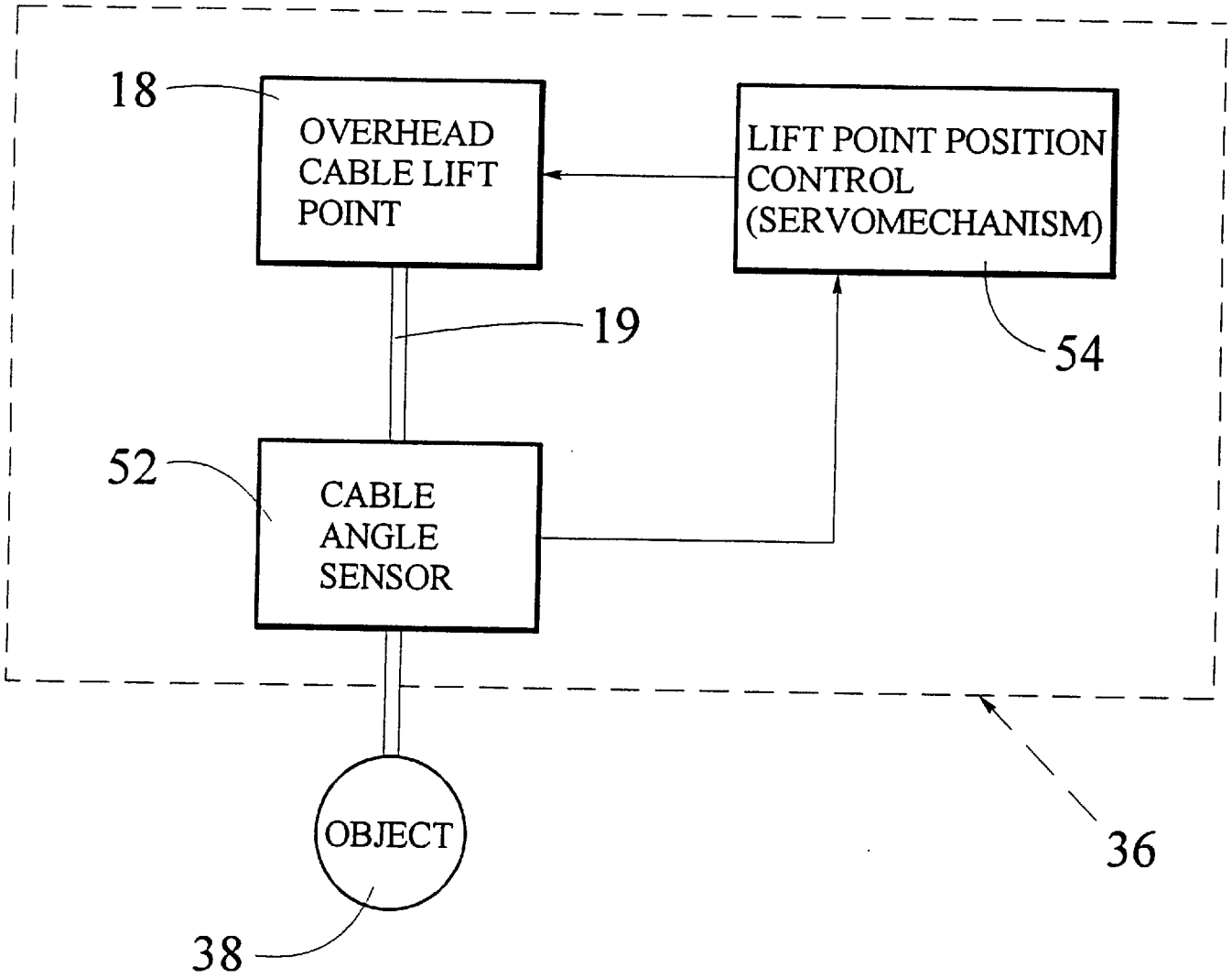
FIG. 6 is a schematic diagram of the cable angle sensor assembly.

FIG. 6 illustrates the operation of the cable lift-point positioning system 36 (see also FIG. 2), aimed at maintaining a vertical orientation of the load-connecting first portion of the cable 19. The operation of the system 36 is carried out in response to a signal from an angle sensor 52. The overhead lift point (guide 18 in FIG. 1) is positioned according to a signal from an angle sensor 52 which measures a deviation of the angle of the cable from vertical. As explained hereinabove, any horizontal movement of the operator during operation of the system—fore, aft or side to side—will place the point of cable attachment to the object in a position no longer directly under the overhead cable lift point. This will give rise to a non-vertical cable, at least in its first portion, and the angle of the deviation will be read by the cable angle sensor 52. The reading of the sensor 52 includes the direction in which the cable has been deflected from vertical, allowing the lift point position control unit 54 (a servomechanism) to move the lift point in the correct direction to attempt to eliminate the non-verticality of the cable 19.

For the embodiment discussed herein, a simulated rocket launch, it may be necessary to conduct the operation outdoors, on an uneven ground. The mechanical components themselves (e.g. frame) are subject to distortion from the original shape under load and this may cause a non-horizontal movement of the gantry (FIG. 1). Additionally, the frame 10 may not be placed on a level surface. The above factors may make it more difficult to determine a deviation of the cable from vertical. However, means for determining the actual position of the cable in relation to vertical in the above-described conditions are known in the art. For simplicity, the frame 10 may be designed to be used on a reasonably level surface or have level adjustment means (e.g. telescopic legs). The overhead frame may also be designed with sufficient rigidity such that negligible deflection occurs under load encountered during the operation of the system.

Referring now to FIG. 7, a preferred actuator/transmission mechanism assembly is illustrated. The pneumatic ROMAC actuator 30 is coupled with a five-pulley tackle 50 which has a line 56 wound around the pulleys 58. One end of the line 56, as illustrated, extends into the cable for connecting to the object to be lifted, while the other end is engaged with the take-up mechanism. As well known, the tackle will amplify the stroke of the actuator six times while attenuating its tensile force by the same factor. Of course, the degree of amplification/attenuation can be predetermined by selecting the number of pulleys to match the cable tension and operator's vertical movement accommodation requirements.

The embodiment described above and illustrated in FIGS. 1–7 operates in two distinct modes. One mode characterizes the system as prepared for firing (or, generally, the application of displacement force on an object). In this mode, the actuator 30 (FIGS. 2, 4 and 5) is inactive, the brake 28 (FIGS. 2, 4 and 5) is not engaged and the spooling motor (take-up means) 26 (FIGS. 2, 4 and 5) is maintaining low cable tension. The second mode of operation is the instant of firing and onwards: the spooling motor 26 is disengaged, the brake 28 is engaged and the actuator 30 is creating a high (tensile) force in the cable (link) 19. In the above-described embodiment, the two modes are executed by separate components.

As exemplified below, the functions of the two modes can be implemented with a single set of physical components.

Figure 8:
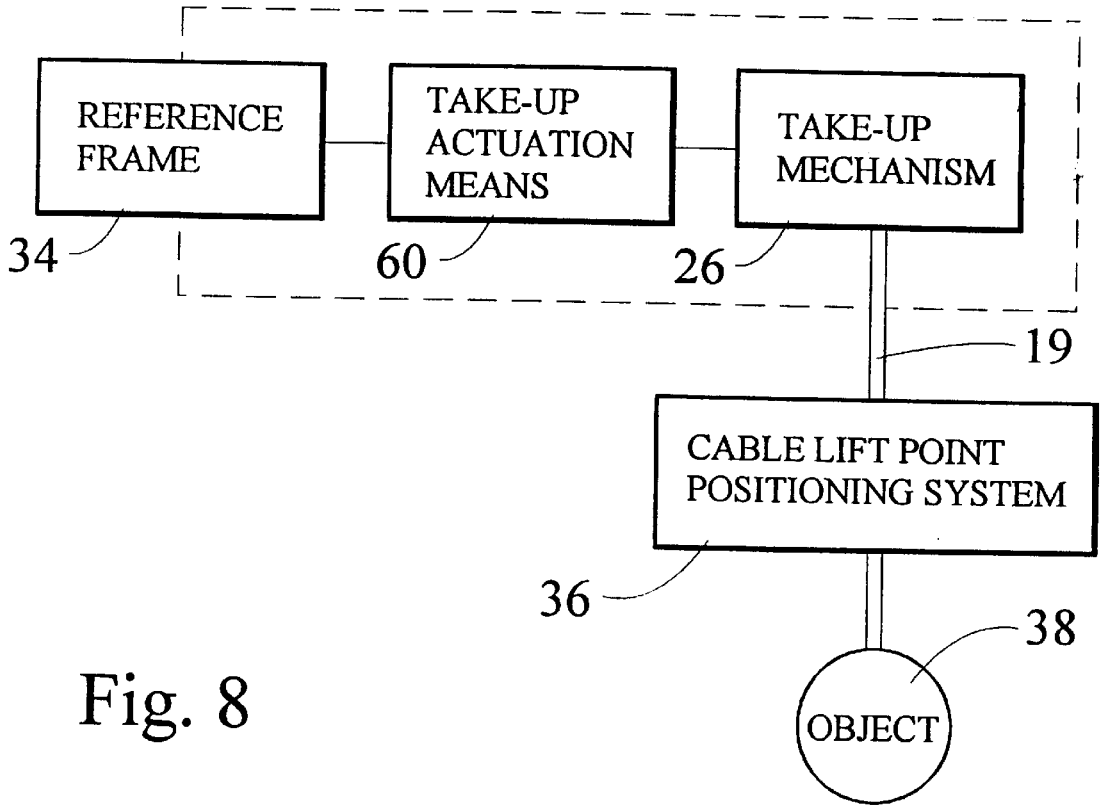
FIG. 8 is a block diagram of the basic components of a second embodiment of the system of the invention.

As shown in FIG. 8, the brake, actuator and actuator transmission mechanism of FIG. 2 have been eliminated. A take-up actuation means 60 with take-up mechanism 26, for example a spooling wind-up motor and a drum are used instead, the motor having sufficient capacity to exert the high tensile force which is produced by the ROMAC actuator in the first embodiment. The other elements of FIG. 8 are the same as in FIG. 2.

Figure 9:
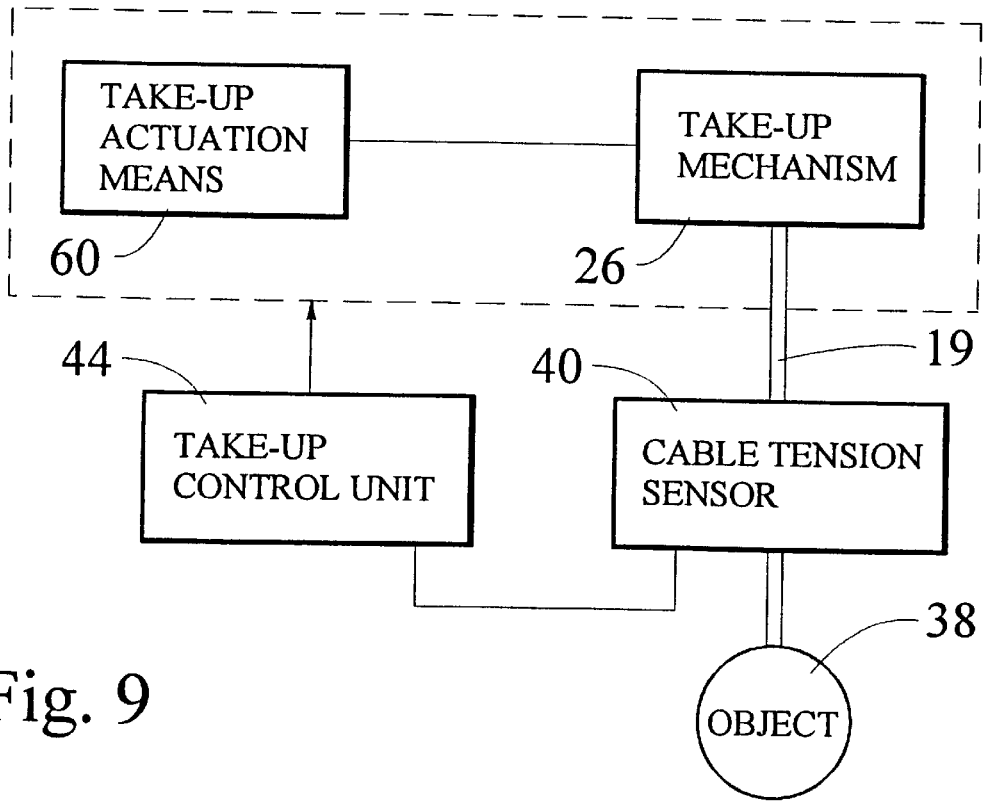
FIG. 9 is a block diagram illustrating the functioning of the second embodiment.

The operation of the second embodiment is represented in FIG. 9 wherein the dotted line represents the modified take-up/actuation assembly. In operation, before "firing", the spooling motor with the drum maintains a constant cable tension like the take-up mechanism of FIG. 4. For the "firing", a sufficiently high power is supplied to the motor to create the required force (as a function of time) in the cable 19. The (tensile) force in the cable is monitored via the sensor 40 and a respective signal is generated thereby and fed to the take-up control unit 44. The unit 44 in turn governs the performance of the take-up assembly 60, 26.

While the single set of components appears simpler, its proper performance may be difficult to secure. In order to create the high tensile force to be applied to the object 38, a significantly large motor is required with correspondingly high drive power demands. Related problems may occur in the functioning of the power electronics which may be significantly taxed. The spooling-only embodiment of FIGS. 8 and 9 also requires a much larger range of operational capability for the spooling control system 44 since the system is expected to maintain correct force in the link 19 at both high and low settings. A large motor may be encumbered with insufficient sensitivity in maintaining the low setting.

The reliability of the second embodiment would also have to be addressed. A malfunction of a system without a brake and with no stroke limitation (as in the case of ROMAC muscle-like actuator) could have serious consequences, for instance if the spooler went into a runaway action due to a linkage failure or another component damage.

It is a feature of the invention that a system is provided to exert a controlled force on an object while the motion of the object (stroke, displacement, lift) can be ignored as a secondary result, if any, of the force.

It will be understood that the system, at least in the above-described application, may function satisfactorily without the guide means (exemplified by the cable lift point positioning system 36) if certain deviations from the predetermined direction (e.g. vertical) of the object-displacement force can be admitted.

It will be appreciated by those in the art that numerous modifications can be made by those skilled in the art without departing from the spirit and scope of the invention as claimed.

We claim:

1. A system for exerting a predetermined force on an object in a predetermined direction, said system comprising:

a reference structure disposed at a predetermined position relative to said object, an actuator associated with said reference structure for generating a force of predetermined magnitude versus time waveform, a control means operatively connected with said actuator for activating the actuator in a predetermined time-related manner, a link means operatively connecting said object with said actuator for imparting, in operation, said force onto the object, and tension maintaining means for maintaining a low predetermined tension in said link means during the absence of said force.

2. The system of claim 1 wherein said actuator is a tensile force generating actuator.

3. The system of claim 2 wherein said reference structure is disposed over said object, said system further comprising a flexible, substantially non-stretchable link means operatively connecting said object with said actuator for imparting, in operation, said tensile force onto said object, said link means having a first portion adapted to be attached to said object, a movable guide means associated with said reference structure for engaging and guiding said link means for a longitudinal passing thereof over said guide means and for vertical positioning of said first portion of said link means when said object is attached thereto, and control means for controlling, in operation, a position of said guide means relative to a position of said object with respect to said reference structure when attached to said link means.

4. The system according to claim 2 wherein said tension maintaining means comprises a take-up means for maintaining, in operation, said predetermined tension in said link means.

5. The system according to claim 4 further comprising a brake associated with said link means for locking said link means and preventing a tensioning action of said take-up means.

6. The system according to claim 4 further comprising a tension sensor associated with said take-up means for generating a signal indicative of a tension in said first portion of said link means.

7. The system of claim 1 further comprising a guide means associated with said reference structure for guiding said link means in a manner to impart thereto a predetermined orientation.

8. The system of claim 7 further comprising positioning means for moving said guide means relative to said reference structure into a preset position.

9. The system of claim 8 further comprising control means for controlling, in operation, a position of said guide means relative to a position of said object with respect to said reference structure when attached to said link means.

10. The system according to claim 7 wherein said guide means is movable in a direction perpendicular to the vertical, to maintain, in operation, a vertical position of said first portion of said link means.

11. The system according to claim 10 further comprising a verticality sensor for generating a signal indicative of a deviation of said first portion of said link means from a vertical orientation.

12. The system according to claim 1 wherein said actuator is a robotic muscle-like actuator.

13. The system according to claim 1 wherein said link means is connected to said object at a point having a predetermined relationship to the center-of mass of a portion of said object.

14. The system according to claim 1, wherein the actuator for generating said force is one that generates a stroke-independent force of predetermined magnitude vs. time waveform and the system further comprises, a sensor means for monitoring a stress created in said link means by said force and for generating a signal indicative of said stress and feeding said signal to said control means.

15. A system for exerting a predetermined force on an object in a predetermined direction, said system comprising:

a reference structure disposed at a predetermined position relative to said object, an actuator associated with said reference structure for generating a force of predetermined magnitude versus time waveform, a control means operatively connected with said actuator for activating the actuator in a predetermined time-related manner, and a link means operatively connecting said object with said actuator for imparting, in operation, said force onto the object, said control means, during the absence of said force, providing a control signal to said actuator to generate and maintain a low predetermined tension in said link means.

16. A system for generating and applying a transient force of a predetermined magnitude versus time profile on an object, said system comprising:

a reference structure disposed at a predetermined position relative to said object;

a first force generating means securely positioned with respect to said reference structure and operatively coupled to said object by a link means;

another force generating means, coupled to said link means, for maintaining a low steady force on said object through said link means during the absence of said transient force; and a control means, operatively connected to both force generating means, for selectively inactivating said another force generating means prior to activating said first force generating means;

said first force generating means, when activated, generating a force that is transmitted to said object through said link means whereby said object is subjected to said transient force.

17. A system for generating and applying a transient force as defined in claim 16 further comprising a means for confining movement of said link means with respect to said another force generating means when said another force generating means is inactivated.

* * * * *